US009403200B2

(12) United States Patent
Shimizu

(10) Patent No.: US 9,403,200 B2
(45) Date of Patent: Aug. 2, 2016

(54) CARBON STEEL WIRE WITH HIGH STRENGTH AND EXCELLENT DUCTILITY AND FATIGUE RESISTANCE, PROCESS FOR PRODUCING THE SAME, AND METHOD OF EVALUATING THE SAME

(75) Inventor: Wataru Shimizu, Nasushiobara (JP)

(73) Assignee: BRIDGESTONE CORPORATION, Tokyo (JP)

( * ) Notice: Subject to any disclaimer, the term of this patent is extended or adjusted under 35 U.S.C. 154(b) by 1387 days.

(21) Appl. No.: 13/126,578

(22) PCT Filed: Oct. 30, 2009

(86) PCT No.: PCT/JP2009/068711

§ 371 (c)(1), (2), (4) Date: Apr. 28, 2011

(87) PCT Pub. No.: WO2010/050596

PCT Pub. Date: May 6, 2010

(65) Prior Publication Data

US 2011/0206552 A1 Aug. 25, 2011

(30) Foreign Application Priority Data

Oct. 30, 2008 (JP) ..... 2008-279758

(51) Int. Cl.

| | |
|---|---|
| ***B21C 37/04*** | (2006.01) |
| ***B21C 1/00*** | (2006.01) |
| ***D07B 1/06*** | (2006.01) |
| ***C21D 7/10*** | (2006.01) |
| ***C21D 8/06*** | (2006.01) |
| ***C21D 9/52*** | (2006.01) |
| ***C21D 1/55*** | (2006.01) |

(52) U.S. Cl.

CPC ..... *B21C 37/045* (2013.01); *B21C 1/003* (2013.01); *C21D 7/10* (2013.01); *C21D 8/065* (2013.01); *C21D 9/525* (2013.01); *D07B 1/066* (2013.01); *C21D 1/55* (2013.01); *C21D 2211/009* (2013.01); *D07B 2205/3053* (2013.01); *D07B 2205/3057* (2013.01)

(58) Field of Classification Search

CPC ..... B21C 1/003; B21C 37/045; C21D 7/10; C21D 8/065; C21D 9/525; C21D 2211/009; D07B 1/066; D07B 2205/3053; D07B 2205/3057; D07B 2801/10

USPC ..... 420/8, 99; 72/274

See application file for complete search history.

(56) References Cited

U.S. PATENT DOCUMENTS

| | | | | |
|---|---|---|---|---|
| 2002/0014477 | A1 | 2/2002 | Lee et al. | |
| 2003/0066575 | A1 * | 4/2003 | Nagao et al. | 148/320 |

FOREIGN PATENT DOCUMENTS

| | | | |
|---|---|---|---|
| JP | 05-200428 | A | 8/1993 |
| JP | 07-305285 | A | 11/1995 |
| JP | 08-156514 | A | 6/1996 |
| JP | 08-311788 | A | 11/1996 |
| JP | 11-309509 | A | 11/1999 |
| JP | 2002-113541 | A | 4/2002 |
| JP | 2006-249561 | A | 9/2006 |
| JP | 2008-208450 | A | 9/2008 |
| JP | 2009-280836 | A | 12/2009 |

OTHER PUBLICATIONS

Extended European Search Report issued Oct. 24, 2013 in corresponding European Patent Application No. 09823706.8.

* cited by examiner

*Primary Examiner* — Roy King
*Assistant Examiner* — Caitlin Kiechle
(74) *Attorney, Agent, or Firm* — Sughrue Mion, PLLC

(57) ABSTRACT

A carbon steel wire with unprecedentedly high strength and excellent ductility and fatigue resistance, a process for producing the same, and a method of evaluating the same are provided. Provided is a carbon steel wire having a carbon content of 0.50 to 1.10% by mass, wherein the ratio of the hardness of the surface layer portion on a cross section and the hardness of the surface layer portion on a longitudinal section is represented by a coefficient X1, and the ratio of the hardness of the center portion on the cross section and the hardness of the center portion on the longitudinal section is represented by a coefficient X2, wherein X1 and X2 satisfy the following expressions: 0.9<coefficient X1≤1.10, and 0.9<coefficient X2≤1.10, and wherein the carbon steel wire has a tensile strength of 4000 MPa or higher.

5 Claims, 2 Drawing Sheets

CARBON STEEL WIRE WITH HIGH STRENGTH AND EXCELLENT DUCTILITY AND FATIGUE RESISTANCE, PROCESS FOR PRODUCING THE SAME, AND METHOD OF EVALUATING THE SAME

CROSS REFERENCE TO RELATED APPLICATIONS

This application is a National Stage of International Application No. PCT/JP2009/068711 filed Oct. 30, 2009, claiming priority based on Japanese Patent Application No. 2008-279758, filed Oct. 30, 2008, the contents of all of which are incorporated herein by reference in their entirety.

TECHNICAL FIELD

The present invention relates to a carbon steel wire with high strength and excellent ductility and fatigue resistance, a process for producing the same, and a method of evaluating the same.

BACKGROUND ART

For rubber products such as pneumatic tires and industrial belts, in order to reduce the weights of the products and to improve the durability of the products, a high tensile strength and an excellent fatigue resistance is required for a steel cord used as a reinforcement. These days, in order to achieve the same tire strength as the existing conditions while reducing the amount of steel cords used, it is required that the tensile strength of each steel filament of the steel cord as the reinforcement be increased.

In order to meet such demands, many researches and reports from a variety of viewpoints have been made, and it is known to be important that the ductility of a steel wire be increased to attempt to increase the tensile strength. In order to achieve an increase in the tensile strength, an evaluation of properties such as the ductility of a steel wire is therefore performed. For example, when properties such as the ductility of a carbon steel wire are evaluated, conventionally, a technique by which an evaluation is performed by using a cross sectional hardness distribution has been employed.

For example, Patent Document 1 discloses a high strength steel wire which can achieve a high strength by allowing the hardness distribution in a high carbon steel wire to satisfy the condition:

$$0.960 \leq HV \leq 1.030$$

at R=0, R=0.8, R=0.95

(when the radius of the steel wire is $r_0$ and the distance between any point on the steel wire and the center of the steel wire is r, $R=r/r_0$, and when the hardness at the point where R=0.5 is $HV_{0.5}$ and the hardness at the point R is $HV_R$, $HV=HVR/HV_{0.5}$). The Patent Document 2 reports that an ultrahigh strength and a high tenacity can be obtained by making a Vickers hardness distribution on the cross section of a wire of a high carbon steel wire substantially flat from the surface to inside except for the center portion having a fourth of the diameter of the wire.

A variety of production processes are proposed for realizing a high ductility and a high fatigue resistance in a final wet wire drawing process. For example, the Patent Document 3 reports that each reduction of area in the final wire drawing process is adjusted in a predetermined range by a processing strain applied to a material wire of steel cords, for the purpose of obtaining a high quality steel wire also by a general purpose steel cord. The Patent Document 4 reports that a wire drawing process is performed in the final wire drawing process, with each die having a constant reduction of area of about 15% to about 18%, for the purpose of obtaining a high tensile strength steel wire having a high torsional ductility.

RELATED ART DOCUMENT

Patent Document

Patent Document 1: Japanese Unexamined Patent Application Publication No. 8-156514 (Claims or the Like)

Patent Document 2: Japanese Unexamined Patent Application Publication No. 8-311788 (Claims or the Like)

Patent Document 3: Japanese Unexamined Patent Application Publication No. 7-305285 (Claims or the Like)

Patent Document 4: Japanese Unexamined Patent Application Publication No. 5-200428 (Claims or the like)

SUMMARY OF THE INVENTION

Problems to be Solved by the Invention

The conventional method is, however, not necessarily sufficient to achieve a high tensile strength. For example, since the cross sectional hardness is affected by a curled grain (a structure in which a pearlite structure is broken by wire drawing), the hardness is likely to vary depending on the point which is measured and a variation in the hardness becomes large, which lacks reliability in evaluating properties. Thus, in both Patent Documents 1 and 2, since only a hardness distribution on a cross section of the metal wire which was subjected to a wire drawing process is evaluated, which means that the evaluation is performed without considering a variation of the curled grain structure, the evaluation of properties thereof is not necessarily sufficient.

Although only a reduction of area of a die (amount of processing) is adjusted in order to obtain a high ductility, a high fatigue resistance in the final wire drawing process as shown in the Patent Documents 3 and 4, the processes are still not necessarily sufficient as a process for producing a high ductility and a high fatigue resistance steel cord since the conditions of wire drawing during actual processing are affected not only by the reduction of area but also by the status of friction between die/wire, the tensile strength of steel and the like.

Accordingly, an object of the present invention is to provide a carbon steel wire with unprecedentedly high strength and excellent ductility and fatigue resistance, a process for producing the same, and a method of evaluating the same.

Means for Solving the Problem

In order to solve the above-described problems, the carbon steel wire of the present invention is a carbon steel wire having a carbon content of 0.50 to 1.10% by mass, wherein the ratio of the hardness of the surface layer portion on a section (cross section) orthogonal to the longitudinal direction and the hardness of the surface layer portion on a section (longitudinal section) in the longitudinal direction is represented by a coefficient X1, and the ratio of the hardness of the center portion on the cross section and the hardness of the center portion on the longitudinal section is represented by a coefficient X2, wherein X1 and X2 satisfy the following expressions:

$$0.9 < \text{coefficient } X1 \leq 1.10, \text{ and}$$

$$0.9 < \text{coefficient } X2 \leq 1.10;$$

and that the carbon steel wire has a tensile strength of 4000 MPa or higher.

The process for producing a carbon steel wire of the present invention is characterized in that, in a final wet wire drawing process, when a carbon steel wire having a carbon content of 0.50 to 1.10% by mass and having a pearlite structure is subjected to a wire drawing process in each die, the number of die in which a coefficient A represented by the following formula composed of the die reaction and the diameter at the die exit:

$$\text{coefficient } A = (\text{die reaction (kgf)}/\text{diameter at the die exit (mm)}^2)$$

is higher than 95 is two or less, and that a processing strain $\epsilon$ larger than 2.5 is applied in the final wet wire drawing process.

In the production process of the present invention, it is preferable that, in the final wet wire drawing process, the coefficient A for each die is 90 or lower.

A method of evaluating the ductility of a carbon steel wire of the present invention is characterized in that, the ductility is evaluated by whether or not the ratio of the hardness of the surface layer portion on a section (cross section) orthogonal to the longitudinal direction and the hardness of the surface layer portion on a section (longitudinal section) in the longitudinal direction represented by a coefficient X1, and the ratio of the hardness of the center portion on the cross section and the hardness of the center portion on the longitudinal section represented by a coefficient X2 satisfy the following expressions:

$$0.9 < \text{coefficient } X1 \leq 1.10 \text{ and}$$

$$0.9 < \text{coefficient } X2 \leq 1.10.$$

Effect of the Invention

By the present invention, a carbon steel wire with unprecedentedly high strength and excellent ductility and fatigue resistance can be obtained. Further, the ductility of a carbon steel wire can be suitably evaluated, and a carbon steel wire having a good ductility can be surely obtained.

MODE FOR CARRYING OUT THE INVENTION

The embodiments of the present invention will now be described concretely.

The carbon steel wire of the present invention is a high carbon steel wire having a carbon content of 0.50 to 1.10% by mass, preferably 0.85 to 1.10% by mass. When the carbon content is less than 0.50% by mass, a proeutectoid ferrite becomes likely to deposit, which causes an unevenness in the metallographic structure, and a total amount of a wire drawing process in order to obtain a high strength becomes large. On the other hand, when the carbon content exceed 1.10% by mass, a proeutectoid cementite becomes likely to deposit on the grain boundary, which causes an unevenness in the metallographic structure.

It is essential for the carbon steel wire of the present invention that the ratio of the hardness of the surface layer portion on a section (cross section) orthogonal to the longitudinal direction and the hardness of the surface layer portion on a section (longitudinal section) in the longitudinal direction is represented by a coefficient X1, and the ratio of the hardness of the center portion on the cross section and the hardness of the center portion on the longitudinal section is represented by a coefficient X2, satisfy the following expressions:

$$0.9 < \text{coefficient } X1 \leq 1.10 \text{ and}$$

$$0.9 < \text{coefficient } X2 \leq 1.10.$$

In the drawn carbon steel wire, the longitudinal sectional hardness is not affected by a curled grain, and the hardness is determined depending on the array of lamella, so that the hardness can be evaluated without a variation. Accordingly, it was considered that a more appropriate evaluation of characteristics could be performed by evaluating the ratio of the cross sectional hardness based on the longitudinal sectional hardness, and an evaluation test was performed. It was confirmed that those having a good ductility can be obtained when the ratio of hardness in the center of wire, a coefficient X2 is higher than 0.90. The lower limit was, therefore, set to 0.90. On the other hand, the upper limit was set to 1.10 because the best ductility was obtained when the ratio of the hardness of the surface layer portion of the wire, a coefficient X1 was 1.04 and a good ductility was obtained also when the coefficient X1 was 1.10.

Figure 1:
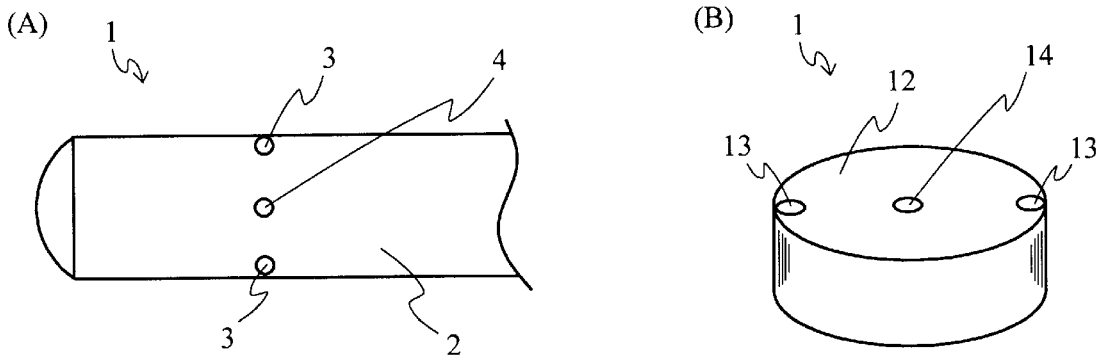
FIG. 1(A) is a drawing for explaining the point at which the hardness of the longitudinal section of a steel wire is measured.
FIG. 1(B) is a drawing for explaining the point at which the hardness of the cross section of a steel wire is measured.

Here, the longitudinal sectional hardness was measured at the surface layer portion 3 and the center portion 4 on the cross section 2 of the carbon steel wire 1 as shown in FIG. 1(A), and the cross sectional hardness was measured at the surface layer portion 13 and the center portion 14 on the cross section 12 of the carbon steel wire 1 as shown in FIG. 1(B). For such a hardness, for example, Vickers hardness can be preferably employed.

The carbon steel wire of the present invention has a tensile strength of 4000 MPa or higher, and it thus becomes possible to achieve the same tire strength as the existing conditions while reducing the amount of steel cords used.

Next, a process for producing a carbon steel wire of the present invention described above will be described. It is essential for the production process of the present invention that, during the production of a carbon steel wire of the present invention, in a final wet wire drawing process, when a carbon steel wire having a carbon content of 0.50 to 1.10% by mass and having a pearlite structure is subjected to a wire drawing process in each die, the number of die in which a coefficient A represented by the following formula composed of the die reaction and the diameter at the die exit:

$$\text{coefficient } A = (\text{die reaction (kgf)}/\text{diameter at the die exit (mm)}^2)$$

is higher than 95 is two or less, and that a processing strain $\epsilon$ larger than 2.5 is applied in the final wet wire drawing process, and preferably the coefficient A is set 90 or lower for all the die.

As in the present invention, by evaluating not only a reduction of area but also the above-described coefficient A in the final wet wire drawing process, an evaluation covering every condition such as steel material, tensile strength, wire diameter, frictional coefficient or the like can be performed. As the result, conditions including every factor which affects the quality and physical property can be represented, and more concrete conditions for wire drawing as compared to a previous single condition which is the reduction of area can be represented.

In the present invention, the number of die whose coefficient A is higher than 95 is set 2 or less because, if a wire drawing process is performed in a condition in which the number is larger than 2, the structure of steel becomes fragile due to the amount of processing and friction, thereby decreasing ductility and fatigue resistance. On the other hand, the lower limit of the coefficient A is preferably 30 or higher with three or more head dies because a wire drawing process on die becomes uneven when the coefficient is too low.

When the above-described ratio represented by X1 and the above-described ratio represented by X2 satisfy the following expressions:

$$0.9<\text{coefficient } X1\leq 1.10, \text{ and}$$

$$0.9<\text{coefficient } X2\leq 1.10,$$

it is particularly preferred that, a processing strain of 2.5 or larger is satisfied in which, in the final wet wire drawing process, the pearlite structure is oriented in the wire drawing direction and curled grain in the cross direction structure is compactly formed. The processing strain $\epsilon$ is calculated by the following formula:

$$\epsilon=2\cdot\ln(D0/D1)$$

(where D0 represents a diameter (mm) of the steel wire on the inlet of the wire drawing process, D1 represents a diameter (mm) of the steel wire on the outlet of the wire drawing process).

The method of evaluating the ductility of a carbon steel wire of the present invention is a method of evaluating the ductility of a carbon steel wire in which, during the evaluation of the ductility of a carbon steel wire, the ductility is evaluated by whether or not the ratio of the hardness of the surface layer portion on a section (cross section) orthogonal to the longitudinal direction and the hardness of the surface layer portion on a section (longitudinal section) in the longitudinal direction represented by a coefficient X1, and the ratio of the hardness of the center portion on the cross section and the hardness of the center portion on the longitudinal section represented by a coefficient X2, satisfy the following expressions:

$$0.9<\text{coefficient } X1\leq 1.10 \text{ and}$$

$$0.9<\text{coefficient } X2\leq 1.10.$$

As described above, by evaluating the ratio of hardness and the coefficients X1 and X2, and selecting the values within the above-described ranges, those having a good ductility can be surely obtained.

As the shape of the die, shapes which are generally used for drawing steel wires can be applied, and for example, those having an approach angle of 8° to 12°, and a bearing length of approximately 0.3 D to 0.6 D can be used. Further, the die materials are not limited to a sintered diamond die or the like, and an inexpensive super hard alloy die can also be used.

As the steel wire provided for the wire drawing process, a high carbon steel wire having a good uniformity is preferably used, and preferably subjected to a heat treatment such that a uniform pearlite structure having a small amount of proeutectoid cementite, proeutectoid ferrite or bainite mixed together are formed while controlling decarbonization on the surface layer portion of the steel wire.

EXAMPLES

The present invention will now be described by way of Examples.

High carbon steel wires shown in the Tables 1 and 2 below were subjected to a dry wire drawing until diameters thereof reach the diameters shown in the same tables respectively. The obtained steel wires were subjected to a patenting heat treatment and a brass plating to produce brass plated steel wires. The obtained brass plated steel wires were drawn in each pass schedule shown in Tables 1 and 2 to produce steel wires having the diameters shown in the Tables respectively.

During the wire drawing process, a super hard alloy die having an approach angle of about 12°, and a bearing length of about 0.5 D, and a slip-type wet continuous wire drawing machine were used.

As the wire drawing conditions in the final wire drawing process, as shown in Tables 1 and 2 below, variable conditions in which the number of die whose coefficient A described above is 95 or higher is 0 (Examples 1 to 3), the number is 8 (Comparative Example 1), and the number is 3 (Comparative Example 2) were used to perform wire drawing processes, and the physical properties below were evaluated.

(Tensile Strength)

The tensile strength of test steel wires were measured based on a tension test according to JIS G3510.

(Hardness)

By using Vickers hardness tester (type: HM-211) manufactured by Mitutoyo Corporation, the hardnesses at the surface layer portion and the center portion of the longitudinal section and cross section of the test steel wire were measured, and each of the ratios, coefficients X1 and X2 were calculated.

(Loop Strength Retention)

Figure 2:
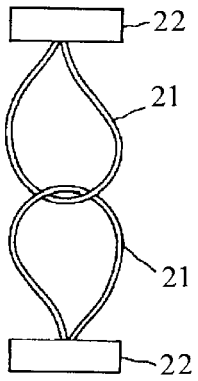
FIG. 2 is a drawing for explaining the measurement of a loop strength retention.

The loop strength retention of the test wire was calculated as:

$$\text{loop strength retention}=((\text{loop strength})/(\text{tensile strength})\times 100),$$

by measuring the loop strength and the tensile strength of a test steel wire 21 mounted on a grip 22 as shown in FIG. 2. This measurement was performed 10 times.

The obtained results are shown in Table 3 below.

TABLE 1

| | | Example 1 | | Example 2 Steel wire material | | Example 3 | |
|---|---|---|---|---|---|---|---|
| | | 1.02% by mass carbon steel wire | | 1.02% by mass carbon steel wire | | 0.80% by mass carbon steel wire | |
| | | wire diameter | Coefficient A | wire diameter | Coefficient A | wire diameter | Coefficient A |
| Pass | 0 | 1.400 | — | 1.320 | — | 1.320 | — |
| | 1 | 1.360 | 10.5 | 1.280 | 19.6 | 1.280 | 19.6 |
| | 2 | 1.290 | 30.1 | 1.200 | 36.4 | 1.200 | 36.4 |
| | 3 | 1.200 | 39.2 | 1.090 | 52.7 | 1.090 | 52.7 |

TABLE 1-continued

| | Example 1 | | Example 2 Steel wire material | | Example 3 | |
|---|---|---|---|---|---|---|
| | 1.02% by mass carbon steel wire | | 1.02% by mass carbon steel wire | | 0.80% by mass carbon steel wire | |
| | wire diameter | Coefficient A | wire diameter | Coefficient A | wire diameter | Coefficient A |
| 4 | 1.100 | 49.0 | 0.960 | 68.8 | 0.960 | 68.8 |
| 5 | 0.990 | 62.0 | 0.850 | 70.3 | 0.850 | 70.3 |
| 6 | 0.890 | 66.1 | 0.750 | 76.8 | 0.750 | 76.8 |
| 7 | 0.790 | 76.8 | 0.670 | 75.4 | 0.670 | 75.4 |
| 8 | 0.700 | 82.7 | 0.600 | 79.0 | 0.600 | 79.0 |
| 9 | 0.640 | 69.1 | 0.540 | 80.8 | 0.540 | 80.8 |
| 10 | 0.580 | 79.2 | 0.490 | 80.2 | 0.490 | 80.2 |
| 11 | 0.530 | 77.6 | 0.450 | 78.4 | 0.450 | 78.4 |
| 12 | 0.485 | 80.7 | 0.415 | 76.9 | 0.415 | 76.9 |
| 13 | 0.445 | 84.5 | 0.385 | 79.7 | 0.385 | 79.7 |
| 14 | 0.410 | 83.7 | 0.355 | 74.3 | 0.355 | 74.3 |
| 15 | 0.375 | 94.1 | 0.340 | 45.4 | 0.340 | 45.4 |
| 16 | 0.345 | 87.4 | 0.315 | 74.1 | 0.330 | 45.8 |
| 17 | 0.320 | 84.8 | 0.295 | 82.8 | 0.310 | 71.1 |
| 18 | 0.295 | 94.1 | 0.270 | 86.9 | 0.290 | 73.8 |
| 19 | 0.273 | 94.7 | 0.255 | 80.9 | 0.275 | 69.2 |
| 20 | 0.255 | 86.4 | 0.240 | 80.0 | 0.260 | 82.1 |
| 21 | 0.240 | 81.9 | 0.230 | 77.5 | 0.245 | 74.1 |
| 22 | 0.225 | 89.3 | 0.220 | 62.6 | 0.230 | 79.8 |
| 23 | 0.215 | 70.6 | 0.210 | 71.9 | 0.220 | 76.3 |
| 24 | 0.210 | 42.2 | 0.200 | 74.6 | 0.210 | 54.2 |
| 25 | — | — | 0.190 | 66.6 | 0.205 | 48.4 |
| 26 | — | — | 0.180 | 70.6 | — | — |
| 27 | — | — | 0.175 | 67.3 | — | — |
| 28 | — | — | 0.170 | 52.1 | — | — |
| | Over 90 | 3 | Over 90 | 0 | Over 90 | 0 |
| | Over 95 | 0 | Over 95 | 0 | Over 95 | 0 |

TABLE 2

| | | Comparative Example 1 1.02% by mass carbon steel wire | | Comparative Example 2 0.80% by mass carbon steel wire | |
|---|---|---|---|---|---|
| Steel wire material | | wire diameter | Coefficient A | wire diameter | Coefficient A |
| Pass | 0 | 1.400 | — | 1.860 | — |
| | 1 | 1.360 | 10.5 | 1.820 | 7.3 |
| | 2 | 1.290 | 34.0 | 1.720 | 15.5 |
| | 3 | 1.200 | 43.1 | 1.560 | 44.3 |
| | 4 | 1.100 | 53.4 | 1.390 | 52.9 |
| | 5 | 0.990 | 66.9 | 1.230 | 60.9 |
| | 6 | 0.890 | 71.2 | 1.080 | 68.5 |
| | 7 | 0.790 | 82.1 | 0.950 | 72.6 |
| | 8 | 0.700 | 88.4 | 0.840 | 75.5 |
| | 9 | 0.640 | 75.5 | 0.735 | 86.4 |
| | 10 | 0.580 | 85.8 | 0.650 | 86.8 |
| | 11 | 0.530 | 84.7 | 0.580 | 87.6 |
| | 12 | 0.485 | 88.1 | 0.520 | 90.3 |
| | 13 | 0.445 | 92.8 | 0.470 | 90.2 |
| | 14 | 0.410 | 92.0 | 0.425 | 97.7 |
| | 15 | 0.375 | 102.8 | 0.390 | 88.9 |
| | 16 | 0.345 | 102.4 | 0.360 | 88.1 |
| | 17 | 0.320 | 99.3 | 0.330 | 92.4 |
| | 18 | 0.295 | 110.1 | 0.305 | 89.9 |
| | 19 | 0.273 | 110.9 | 0.283 | 90.4 |
| | 20 | 0.255 | 100.5 | 0.262 | 96.5 |
| | 21 | 0.240 | 95.5 | 0.245 | 87.2 |
| | 22 | 0.225 | 104.1 | 0.228 | 95.5 |
| | 23 | 0.215 | 82.2 | 0.215 | 84.8 |
| | 24 | 0.210 | 47.1 | 0.205 | 75.1 |
| | 25 | — | — | 0.200 | 44.7 |
| | | Over 90 | 10 | Over 90 | 7 |
| | | Over 95 | 8 | Over 95 | 3 |

TABLE 3

| | Example 1 | Example 2 | Example 3 | Comparative Example 1 | Comparative Example 2 |
|---|---|---|---|---|---|
| Number of die whose coefficient A is larger than 95 | 0 | 0 | 0 | 8 | 3 |
| Number of die whose coefficient A is larger than 90 | 3 | 0 | 0 | 10 | 7 |
| Cross sectional hardness/ Longitudinal sectional hardness | 0.93 | 0.93 | 0.93 | 0.81 | 0.85 |
| Coefficient X2 (Center portion) | | | | | |
| Cross sectional hardness/ | 1.02 | 1.06 | 1.02 | 1.04 | 1.04 |
| Longitudinal sectional hardness | 0.99 | 1.10 | 0.99 | 0.92 | 0.99 |
| Coefficient X1 (Surface layer portion) | | | | | |
| Tensile strength (MPa) | 4300 | 4500 | 4100 | 4300 | 4300 |
| Loop strength retention (%) | 75 | 60 | 85 | 29 | 35 |
| Ductility | High | High | High | Low | Low |

Figure 3:
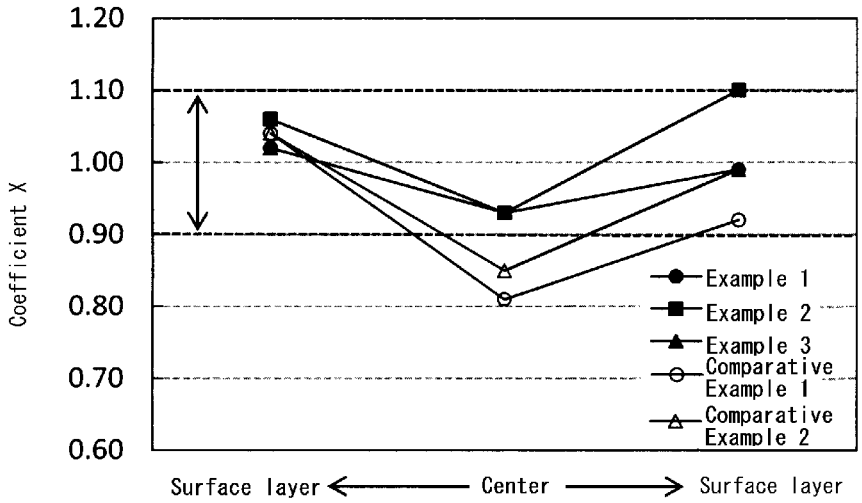
FIG. 3 is a graph representing a relationship between cross sectional hardness/longitudinal sectional hardness, a coefficient X2 (center portion) and cross sectional hardness/longitudinal sectional hardness, a coefficient X1 (surface layer portion) in Examples 1 to 3 and Comparative Examples 1 and 2.

In FIG. 3, a graph of the relationships of cross sectional hardness/longitudinal sectional hardness, coefficient X2 (center portion) and cross sectional hardness/longitudinal sectional hardness, coefficient X1 (surface layer portion) of Examples 1 to 3, and Comparative Examples 1 and 2 is shown. As is clear from this graph, in Examples 1 to 3, the ratio of hardness at the surface layer portion and the center portion is found to be small.

Figure 4:
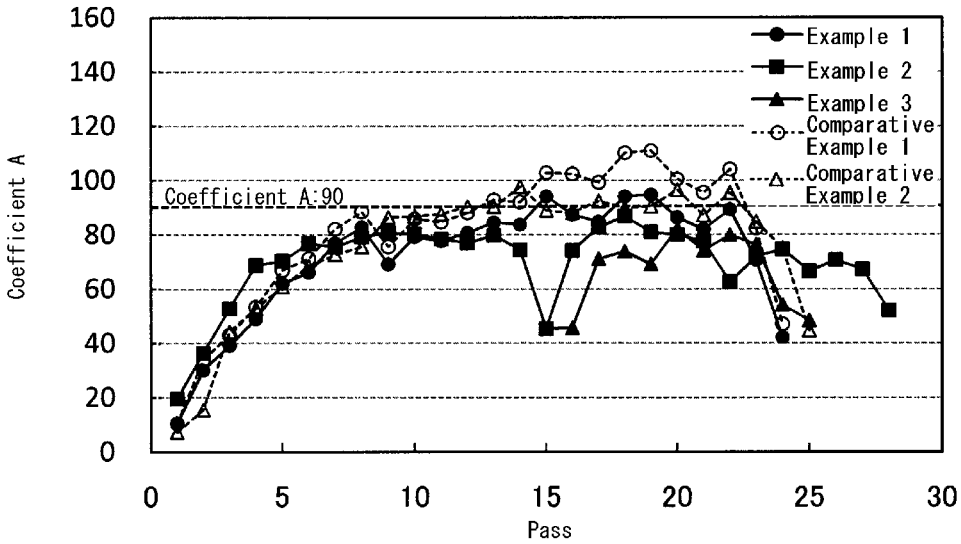
FIG. 4 is a graph, as a pass schedule, showing the relationship between each pass and a coefficient A.

In FIG. 4, a graph of the relationship between each pass and a coefficient A, as a pass schedule is shown. From this graph, it is found that, in Example 1, only three passes whose coefficient is higher than 90, and no passes whose coefficient is higher than 95 exist, and in Examples 2 and 3, no passes whose coefficient A is higher than 90 exist, which are a clearly different pass schedule from that in Comparative Examples 1 and 2.

Description of Symbols

1 steel wire
2 longitudinal section
12 cross section
3, 13 surface layer portion
4, 14 center portion
21 steel wire
22 grip

The invention claimed is:

1. A process for producing a carbon steel wire having a carbon content of 0.50 to 1.10% by mass, wherein a ratio of a hardness of a surface layer portion on a cross section orthogonal to a longitudinal direction and a hardness of a surface layer portion on a longitudinal section in the longitudinal direction is represented by a coefficient X1, and a ratio of a hardness of a center portion on the cross section and a hardness of a center portion on the longitudinal section is represented by a coefficient X2, wherein X1 and X2 satisfy the following expressions:

$$0.9<\text{coefficient } X1\leq 1.10, \text{ and}$$

$$0.9<\text{coefficient } X2\leq 1.10,$$

and wherein the carbon steel wire has a tensile strength of 4000 MPa or higher, wherein, in a final wet wire drawing process, when a carbon steel wire having a carbon content of 0.50 to 1.10% by mass and having a pearlite structure is subjected to a wire drawing process in each die, the number of dies in which a coefficient A represented by the following formula composed of the die reaction and the diameter at the die exit:

$$\text{coefficient } A=(\text{die reaction (kgf)}/\text{diameter at the die exit (mm)}^2)$$

is 90 or lower is all the dies, and wherein a processing strain $\epsilon$ larger than 2.5 is applied in the final wet wire drawing process.

2. The production process according to claim 1, wherein the carbon content is 0.50 to 0.74% by mass.

3. The production process according to claim 1, wherein the carbon content is 0.50 to 0.70% by mass.

4. The production process according to claim 1, wherein the carbon content is 0.50 to 0.60% by mass.

5. The production process according to claim 1, wherein the carbon content is 0.50 to 0.55% by mass.

* * * * *